US012102933B2

(12) United States Patent
Tucker

(10) Patent No.: US 12,102,933 B2
(45) Date of Patent: Oct. 1, 2024

(54) FLEXIBLE TRACK ASSEMBLY

(71) Applicant: Adam Reed Tucker, Arlington Heights, IL (US)

(72) Inventor: Adam Reed Tucker, Arlington Heights, IL (US)

(73) Assignee: Adam Reed Tucker, Arlington Heights, IL (US)

( * ) Notice: Subject to any disclaimer, the term of this patent is extended or adjusted under 35 U.S.C. 154(b) by 375 days.

(21) Appl. No.: 17/659,795

(22) Filed: Apr. 19, 2022

(65) Prior Publication Data

US 2023/0330551 A1 Oct. 19, 2023

(51) Int. Cl.
*A63H 18/02* (2006.01)
*A63H 33/10* (2006.01)

(52) U.S. Cl.
CPC ..... *A63H 18/021* (2013.01); *A63H 33/10* (2013.01)

(58) Field of Classification Search
CPC ..... A63H 18/021; A63H 33/10
USPC ... 446/3, 122, 168, 170, 173, 174, 429, 430, 446/444–447
See application file for complete search history.

(56) References Cited

U.S. PATENT DOCUMENTS 1,191,884 A 7/1916 Finch
3,480,210 A * 11/1969 Perrinjaquet ..... A63F 9/14 238/10 R
3,604,148 A 9/1971 Neuhierl
4,496,100 A 1/1985 Schwager et al.
5,118,320 A 6/1992 Miller
6,602,107 B1 8/2003 Hogan
6,746,298 B1 6/2004 Doepner et al.
7,882,788 B2 * 2/2011 Sorenson ..... A63F 7/3622 104/53
D641,805 S 7/2011 Kichijo et al.
D680,595 S 4/2013 Riley
(Continued)

FOREIGN PATENT DOCUMENTS

WO 1986002856 A1 5/1986
WO 2019115400 A1 6/2019
WO 2020157067 A1 8/2020

OTHER PUBLICATIONS

Huw, The new macaroni tube. Oct. 24, 2016 [online]. [retrieved on Jan. 20, 2022]. Retrieved from the Internet <URL: https://brickset.com/article/24162/the-new-macaroni-tube>.
(Continued)

*Primary Examiner* — Nini F Legesse
(74) *Attorney, Agent, or Firm* — Bishop Diehl & Lee, Ltd.

(57) ABSTRACT

A miniature track assembly having a plurality of central track supports, first track support spacers, and first and second flexible track runners is described. Each track support has a body portion and an extended portion attached to the body portion, the extended portion having a first connection node and a second connection node for detachable connection with the flexible track runners. The first track support spacer is configured to attach to at least one of either a central track support from the plurality of central track supports, or a second track support spacer. The first and second flexible track runners are configured to attach to the connection nodes of the extended portion of each of the plurality of central track supports. The components provide unique design and construction advantages due to the flexible track runner.

17 Claims, 8 Drawing Sheets

(56) References Cited

U.S. PATENT DOCUMENTS

| | | | | |
|---|---|---|---|---|
| 10,493,371 | B2 | 12/2019 | Cochella et al. | |
| 11,779,853 | B2 * | 10/2023 | Forgrave | A63F 7/3622 446/122 |
| 2003/0224696 | A1 * | 12/2003 | Sheltman | A63H 18/08 446/444 |
| 2007/0086607 | A1 | 4/2007 | Holsheimer et al. | |
| 2007/0209543 | A1 | 9/2007 | Beaulieu et al. | |
| 2019/0030445 | A1 | 1/2019 | Luo | |

OTHER PUBLICATIONS

N/A, 5201 LEGO Technic Angle Bricks Assorted. [online], [retrieved on Jan. 21, 2022]. Retrieved from the Internet <URL: https://www.brickeconomy.com/set/5201-1/lego-technic-angle-bricks-assorted>.

N/A. K'NEX Co-cross tie Black—KNEX—60 Pieces. [online], [retrieved on Jan. 20, 2022]. Retrieved from the Internet <URL: https://www.ebay.com/itm/390873713471>.

* cited by examiner

FLEXIBLE TRACK ASSEMBLY

TECHNICAL FIELD OF THE INVENTION

The present invention relates to track assemblies for miniature building sets. More specifically, the invention relates to a flexible track assembly for a roller coaster building set.

BACKGROUND OF THE INVENTION

Miniaturized building systems has been a growing hobby market for a number of years. Each advancement in the industry has permitted expansion in design, creativity, and application. Further, what was once created with a few hundred pieces, is now created with a few thousand pieces. As a result, the detail of each build provides greater authenticity to replicate even the most intricate structures.

However, as popular as replicating existing structures is in the industry, there are those who want to be more creative and more design-oriented with their builds. Unfortunately, existing miniature building systems do not always allow for a wide scope of design creativity. Pieces are often rigid and systems are sold in "kits".

Until the invention of the present application, these and other problems in the prior art went either unnoticed or unsolved by those skilled in the art. The present invention provides a track assembly and kit which are capable of multiple configurations without sacrificing creativity, design, style, or affordability.

SUMMARY OF THE INVENTION

There is disclosed herein an improved miniature track assembly and kit which avoid the disadvantages of prior devices and market offerings while affording additional structural, design and operating advantages.

Generally speaking, the track assembly comprises a plurality of central track supports, a first track support spacer, and first and second flexible track runners. Each track support has a body portion and an extended portion attached to the body portion, the extended portion having a first connection node and a second connection node for detachable connection with the flexible track runners. The first track support spacer is configured to attach to at least one of either a central track support from the plurality of central track supports, or a second track support spacer. The first and second flexible track runners are configured to attach to the connection nodes of the extended portion of each of the plurality of central track supports.

In specific embodiments, the track assembly further comprises a plurality of vertical supports configured to attach to the plurality of central track supports to elevate the track assembly. The vertical supports may be of varying lengths or may be stackable to adjust the track elevation at various points.

In specific embodiments, the track assembly comprises connectors for coupling one of either a central track support to the first track support spacer, the first track support spacer to the second track support spacer, or a central track support to another central track support.

In still other specific embodiments, the first track support spacer have a longitudinal curve to facilitate a curved track design. For such embodiments, a plurality of first track support spacers can be used with some curved and some straight.

Additionally, an assembly kit for building a miniature roller-coaster type structure is also disclosed. The assembly kit comprises a plurality of central track supports, a plurality of track support spacers, a first length of flexible track runner, and a second length of flexible track runner.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
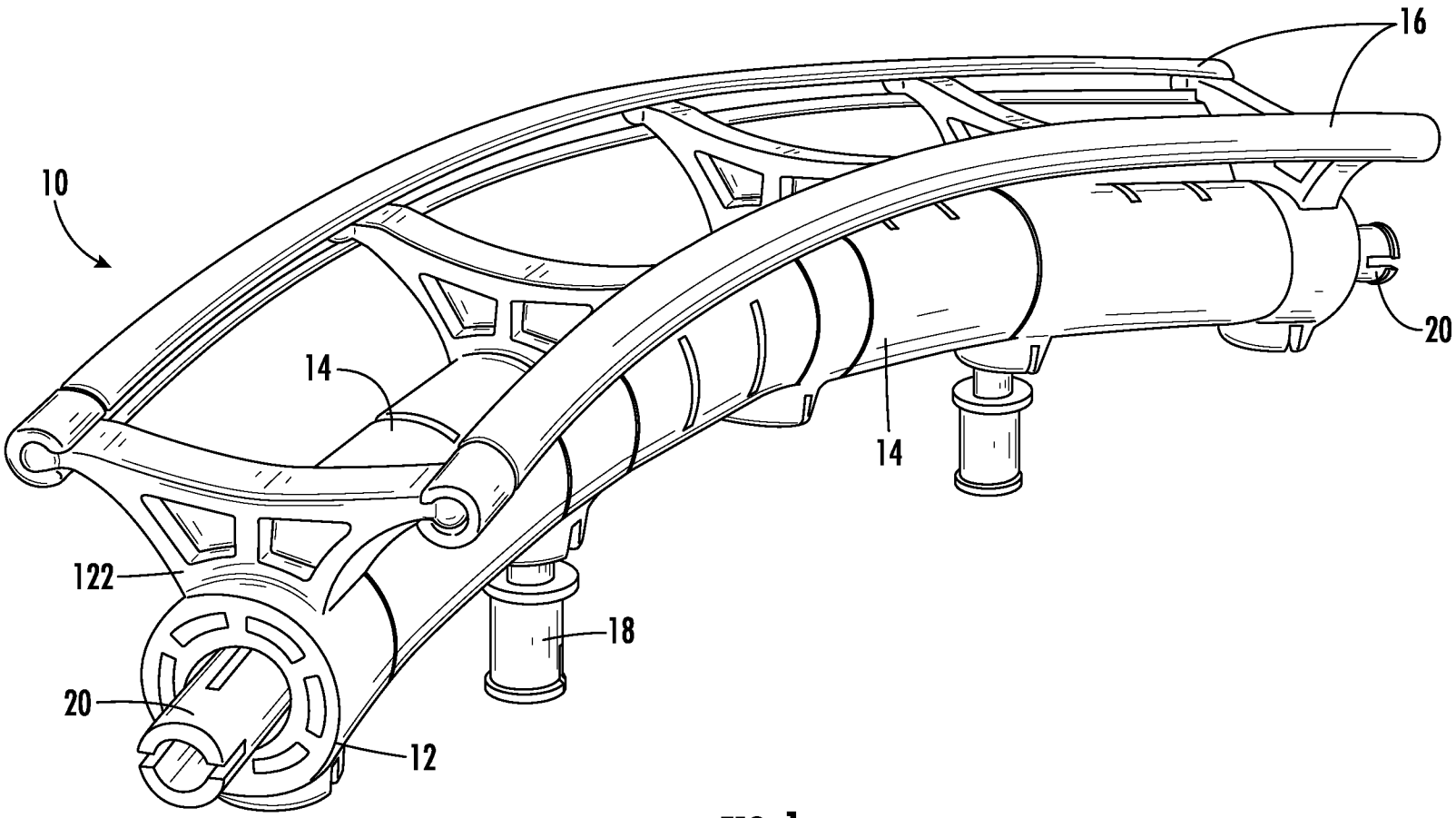
FIG. 1 is a perspective view of an embodiment of a section of curved track assembled in accordance with the present disclosure.
Figure 2A:
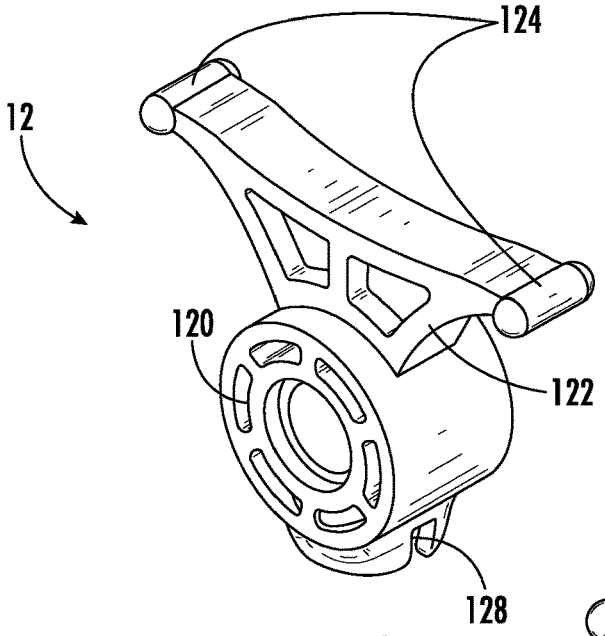
FIG. 2A is a perspective view of an embodiment of a central track support in accordance with the present disclosure.
Figure 2B:
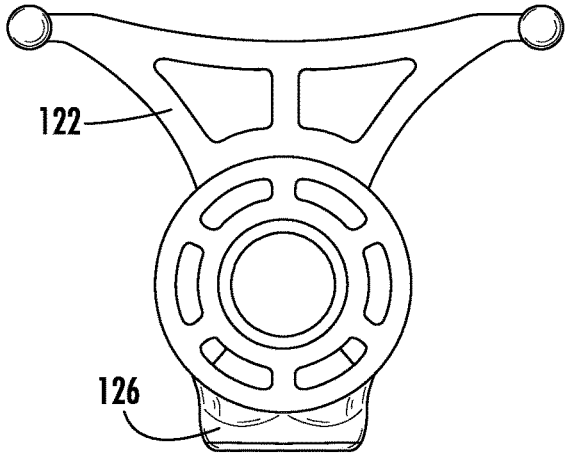
FIG. 2B is a front view of the central track support of FIG. 2A.
Figure 2C:
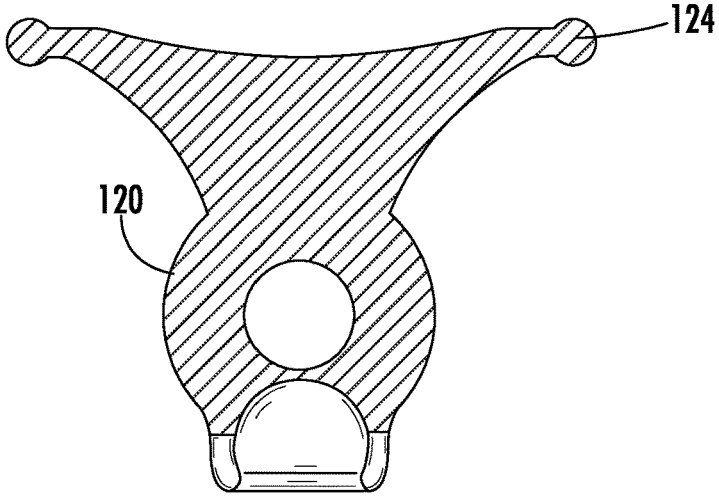
FIG. 2C is a cross-sectional view through line C-C of FIG. 2F.
Figure 2D:
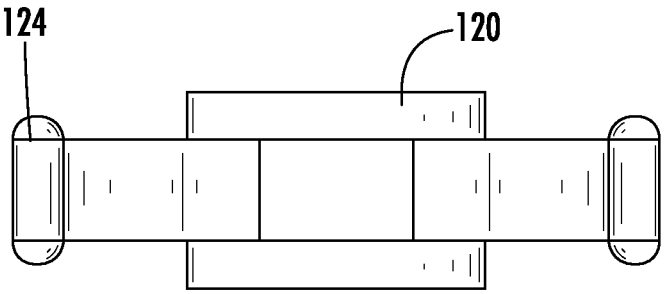
FIG. 2D is a top view of the central track support of FIG. 2A.
Figure 2E:
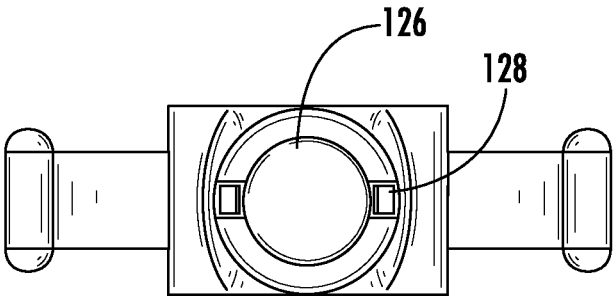
FIG. 2E is a bottom view of the central track support of FIG. 2A.
Figure 2F:
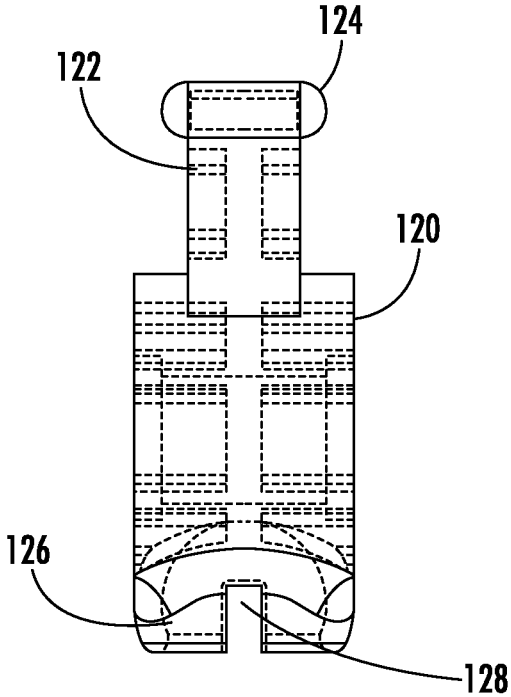
FIG. 2F is a side view of an embodiment of a central track support.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-11, there is illustrated at least one embodiment of a miniature track assembly, generally designated by the numeral 10, and its various components. The particular illustrated track assembly 10 is for designing a miniature roller coaster. However, while all the embodiments illustrated and described are directed to a roller coaster, it should be understood that the principles of the invention can be more broadly applied other track-type miniature systems.

With reference to FIG. 1, a section of the miniature track assembly 10 is shown. The track assembly 10 is comprised of a plurality of central track supports 12, track support spacers 14, and at least two lengths of flexible track runners 16. Additionally, vertical supports 18 and connectors 20 are used in track design and assembly. As shown, the track runners 16 attach to consecutive central track supports 12 to form a track onto which a coaster-car (not shown) can travel. The central track supports 12 are spaced from one another using a plurality of the track support spacers 14, which are connected to one another, and the central track supports 12 using connectors 20. The vertical supports 18 are used to elevate the track by connecting to a bottom surface of the central track supports 12, as explained in further detail below.

Preferably, the numerous components of the disclosed miniature track assembly 10 are molded of a high-quality thermoplastic polymer. For example, the preferred Acrylonitrile Butadiene Styrene (ABS) a strong, physical and chemical-resistive material, with good production qualities. ABS can produce components in most colors and provides good connectivity between components in its final form.

Referring now to FIGS. 2A-2F, the central track support 12 can be more readily understood. The support 12 is comprised of a reinforced, hollow cylindrical body 120 and a trapezoid-like extended portion 122 attached to an upper, outer surface of the body 120. The extended portion 122 includes two spaced connection nodes 124 at upper distal ends. A receptacle 126 on a bottom surface of the body 120 is configured for engagement of the vertical supports 18. The receptacles 126 and support 18 snap-fit to one another, but can certainly be threaded together, friction-fit, or the like, as is known in the art. A notch 128 in the sidewall of the receptacle 126 allows slight expansion of the receptacle 126 when a support 18 is inserted to make connection easier.

Figure 3:
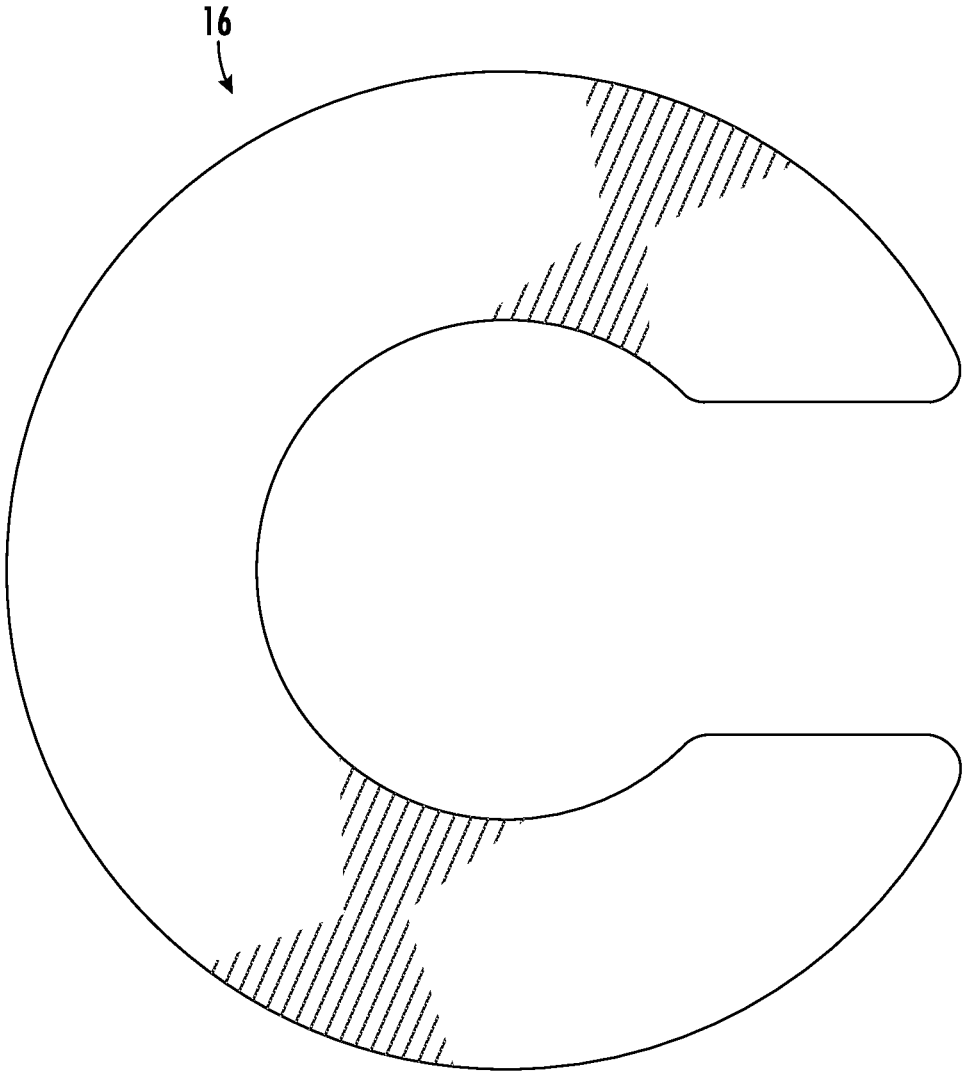
FIG. 3 is a front view of an embodiment of a track runner in accordance with the present disclosure.
Figure 4:
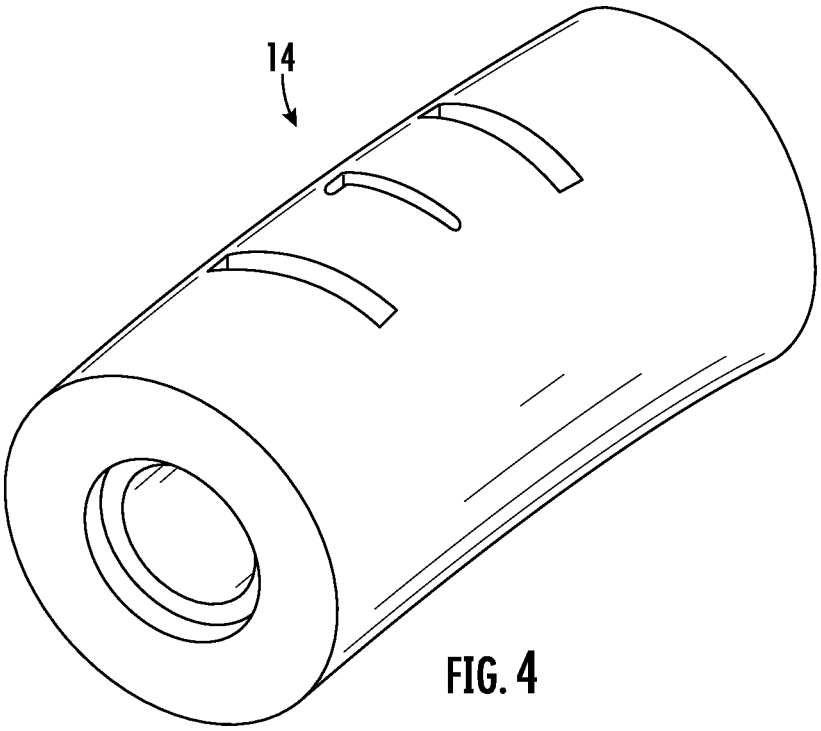
FIG. 4 is perspective view of an embodiment of a track support spacer in accordance with the present disclosure.
Figure 5:
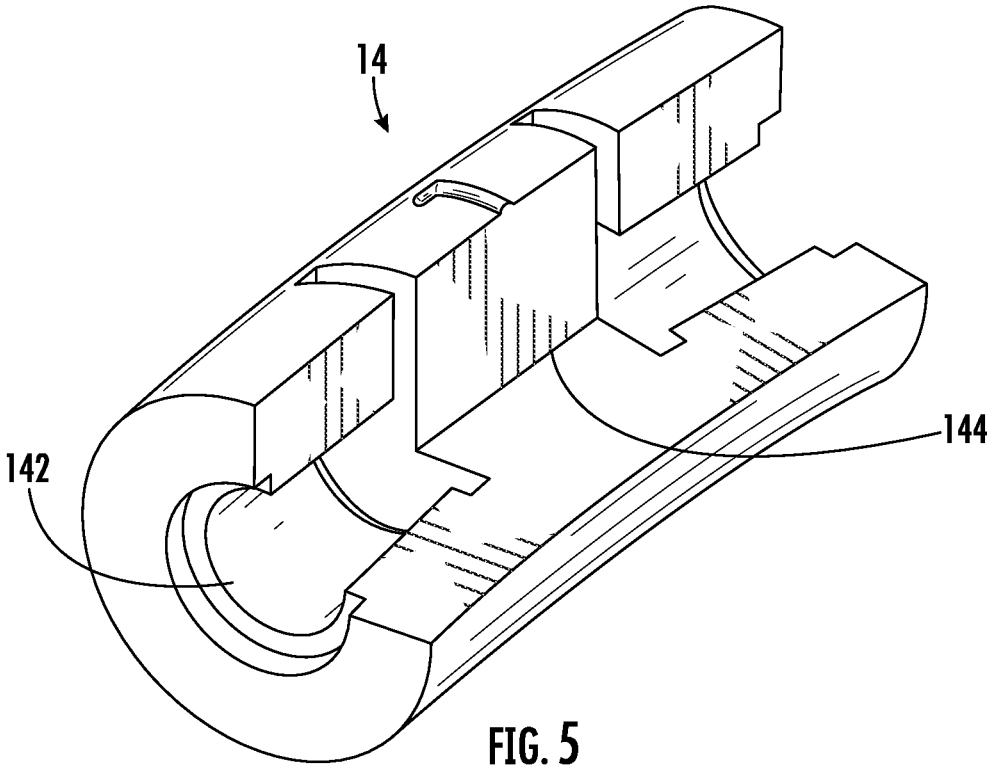
FIG. 5 is a cut-away view of the track support spacer of FIG. 4.
Figure 6:
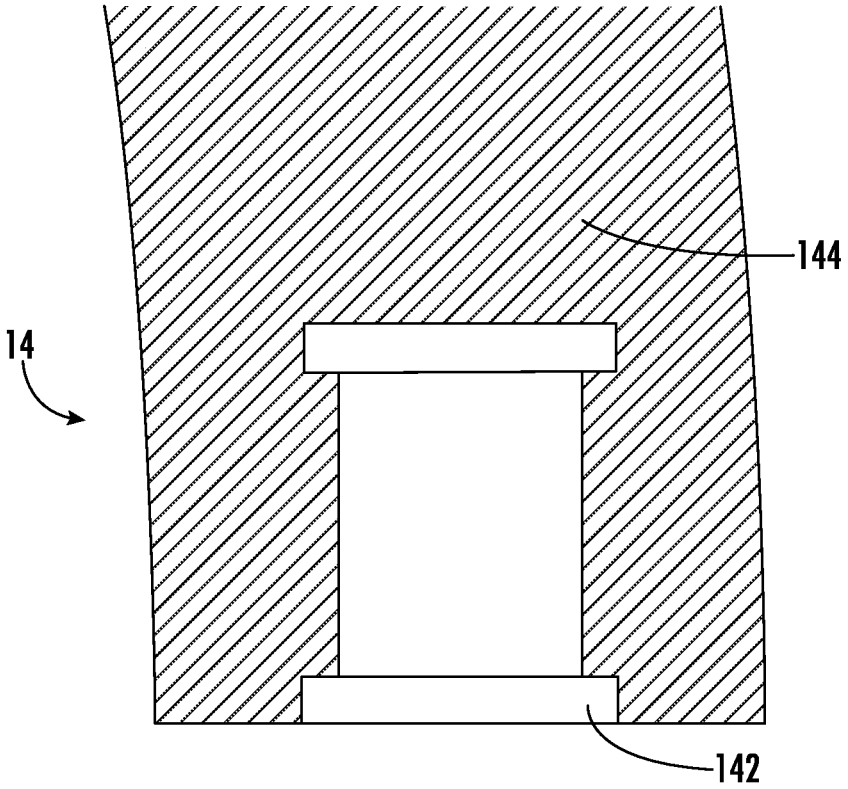
FIG. 6 is a side cross-sectional view of an embodiment of a track support spacer.
Figure 7:
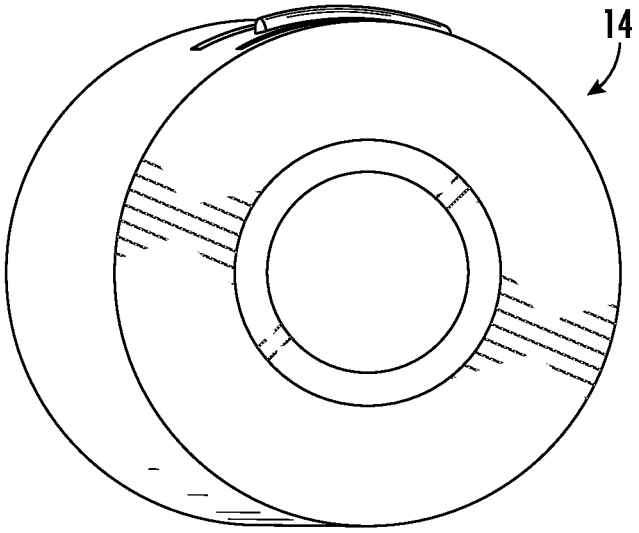
FIG. 7 is a front perspective view of an embodiment of a track support spacer.
Figure 8A:
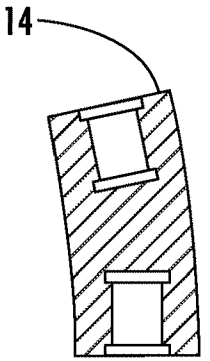
FIGS. 8A-8G are cross-sectional views of embodiments of track support spacers of varying lengths and vary curvature.
Figure 8B:
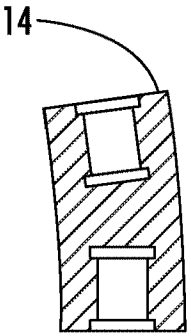
Figure 8C:
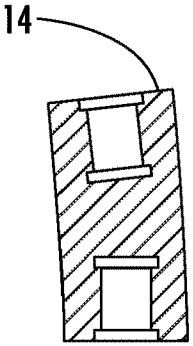
Figure 8D:
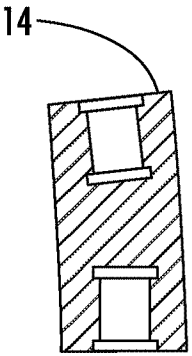
Figure 8E:
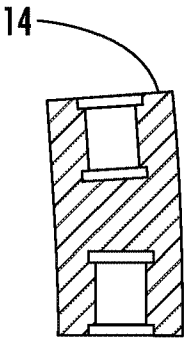
Figure 8F:
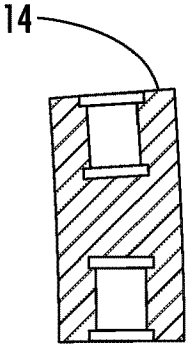
Figure 8G:
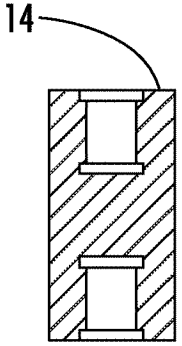
Figure 9A:
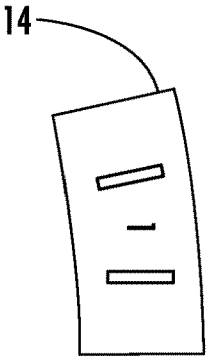
FIGS. 9A-9G are side views of the track support spacers of FIGS. 8A-8G, respectively.
Figure 9B:
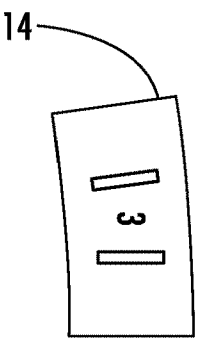
Figure 9C:
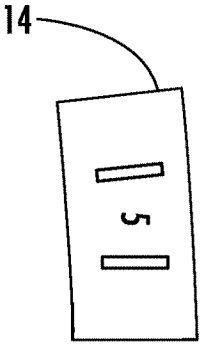
Figure 9D:
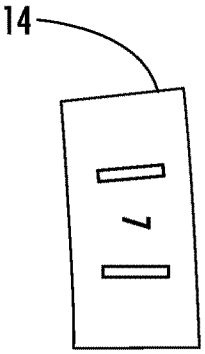
Figure 9E:
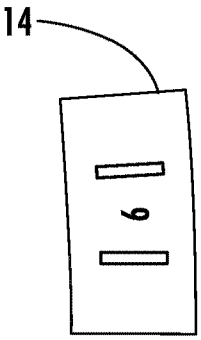
Figure 9F:
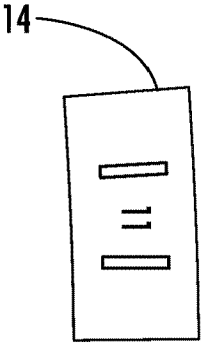
Figure 9G:
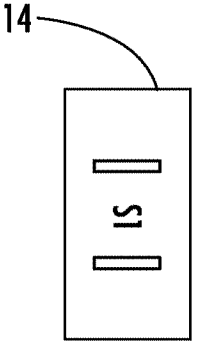

FIG. 3 shows a front view of track runner 16. The flexible runner 16 has a C-shape that extends laterally for the length of the runner. The C-shape allows the track runner 16 to snap-fit or slide onto the connection nodes 124 of the central track support 12. Of course, other outer shapes may be used to provide the desired track surface. The track runner 16 is preferably an extruded polymer which may be cut to any desired length, so long as the length is sufficient to span the distance between consecutive central track supports 12.

An embodiment of the track support spacer 14 is shown in FIGS. 4-7. The spacer 14 is essentially cylindrical with openings 142 at each end, but preferably are blocked at the middle of the spacer 14 by wall 144. This allows connectors 20 to be inserted sufficiently to be secured but prevents over insertion.

The track support spacer 14, of which there are preferably a plurality of for designing and building a track assembly 10, may have different lengths and contours, including straight, as shown in FIGS. 8A-8G and 9A-9G. The degree of curvature, based on the length of any specific piece, preferably falls within the range of about 3° to about 10° (±10%). Larger angles, while possible, may create difficulties for smooth, continuous travel along the track created.

Figure 10:
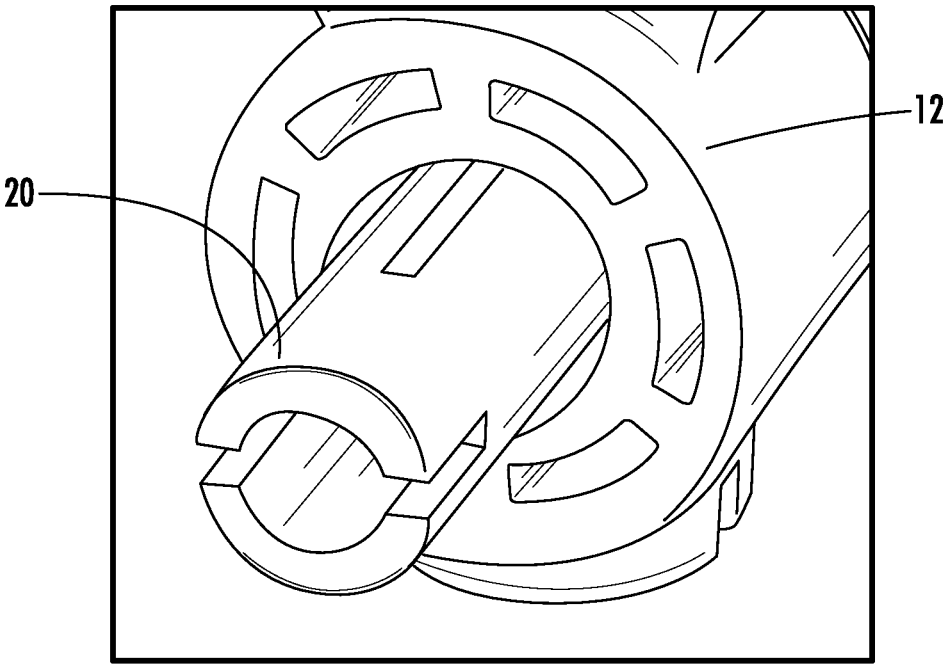
FIG. 10 is a front perspective view of an embodiment of a connector in accordance with the present disclosure.
Figure 11:
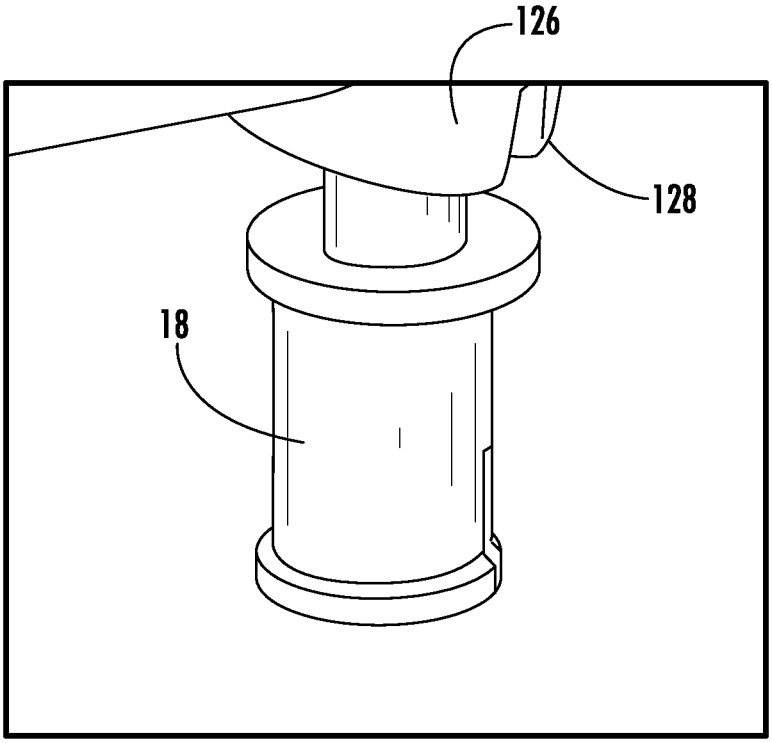
FIG. 11 is a side view of an embodiment of a vertical support in accordance with the present disclosure.

Finally, FIGS. 10 and 11 illustrate a connector 20 and a vertical support 18, respectively, each of which provides an added benefit to the track assembly 10. The connector 20 allows a central track support 12 to be connected to another central track support 12 and/or to a spacer 14. It also allows spacers 14 to be connected to one another, giving each section of the track assembly 10 a desired length and contour.

The vertical support 18 may have a similar design to the connector 20, as it is used to snap or friction-fit within an opening (i.e., receptacle 126). However, to provide varied height support, the vertical support 18 may be stackable and/or have varied body lengths.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A track assembly comprising:

a plurality of central track supports, each having a body portion and an extended portion attached to the body portion, the extended portion having a first connection node and a second connection node;

a first track support spacer configured to attach to at least one of either:

a central track support from the plurality of central track supports; and a second track support spacer;

a first flexible track runner configured to attach to the first connection node of the extended portion of each of the plurality of central track supports; and a second flexible track runner configured to attach to the second connection node of the extended portion of each of the plurality of central track supports.

2. The track assembly of claim 1, further comprising a plurality of vertical supports configured to attach to the plurality of central track supports to elevate the track assembly.

3. The track assembly of claim 1, further comprising connectors for coupling one of either:

a central track support to the first track support spacer;

the first track support spacer to the second track support spacer; and a central track support to another central track support.

4. The track assembly of claim 1, wherein the first track support spacer comprises a longitudinal curve greater than 0 degrees.

5. The track assembly of claim 4, further comprising a plurality of first track support spacers.

6. The track assembly of claim 5, wherein the plurality of first track support spacers comprises at least two different longitudinal curves.

7. The track assembly of claim 6, wherein the plurality of first track support spacers comprises at least six different longitudinal curves.

8. The track assembly of claim 1, wherein the first flexible track runner and second flexible track runner have c-shaped cross-sections.

9. The track assembly of claim 8, wherein the first and second flexible track runners are interchangeable.

10. An assembly kit for building a miniature roller-coaster type structure, the assembly kit comprising:

a plurality of central track supports, each having a body portion and an extended portion attached to the body portion, the extended portion having a first connection node and a second connection node;

a plurality of track support spacers, wherein each track support spacer is configured to attach to at least one of either:

a central track support from the plurality of central track supports; and a track support spacer from the plurality of track support spacers;

a first length of flexible track runner configured to attach to the first connection node of the extended portion of each of the plurality of central track supports; and a second length of flexible track runner configured to attach to the second connection node of the extended portion of each of the plurality of central track supports.

11. The assembly kit of claim 10, further comprising a plurality of vertical supports configured to attach to the plurality of central track supports to elevate portions of the structure.

12. The assembly kit of claim 10, further comprising connectors for coupling together components of at least one of the following:

a central track support to a track support spacer;

a first track support spacer to a second track support spacer; and a first central track support to a second central track support.

13. The assembly kit of claim 10, wherein at least one of the plurality of track support spacers comprises a longitudinal curve greater than 0.

14. The assembly kit of claim 10, further comprising a plurality of vertical supports configured to attach to the plurality of central track supports to elevate the track assembly.

15. The assembly kit of claim 14, wherein the plurality of track support spacers comprises at least two different longitudinal curves.

16. The assembly kit of claim 15, wherein the plurality of track support spacers comprises at least six different longitudinal curves.

17. The assembly kit of claim 10, wherein the first length of flexible track runner and the second length of flexible track runner each have a C-shaped cross-sections.

* * * * *